US007530459B2

(12) United States Patent
Yeh

(10) Patent No.: US 7,530,459 B2
(45) Date of Patent: May 12, 2009

(54) TOOL BOX FOR STORING A TOOL HANDLE AND MULTIPLE TOOL TIPS

(76) Inventor: Shu-Hui Yeh, 14-2, Hsin Sheng Rd., Fu Pao Village, Fu Hsin Hsiang, Changhua Hsien (TW)

( * ) Notice: Subject to any disclaimer, the term of this patent is extended or adjusted under 35 U.S.C. 154(b) by 191 days.

(21) Appl. No.: 11/601,942

(22) Filed: Nov. 20, 2006

(65) Prior Publication Data

US 2008/0035511 A1 Feb. 14, 2008

(30) Foreign Application Priority Data

Aug. 10, 2006 (TW) ..... 95214091 U

(51) Int. Cl.
*B65D 85/28* (2006.01)

(52) U.S. Cl. ..... 206/372; 206/373; 206/377; 206/378; 312/902

(58) Field of Classification Search ..... 206/372, 206/373, 375, 349, 377–379, 759, 762, 765; 211/69
See application file for complete search history.

(56) References Cited

U.S. PATENT DOCUMENTS 5,203,469 A * 4/1993 Chang et al. ..... 220/812
5,535,882 A * 7/1996 Liu ..... 206/377
5,893,457 A * 4/1999 Wei ..... 206/373
6,050,409 A * 4/2000 Delbeck et al. ..... 206/375
6,415,923 B1 * 7/2002 Chen ..... 206/379
6,547,074 B1 * 4/2003 Chen ..... 206/379
6,942,095 B2 * 9/2005 Chen ..... 206/376
7,270,235 B2 * 9/2007 Chen ..... 206/379
2004/0084341 A1 * 5/2004 Amtenbrink ..... 206/372
2005/0023167 A1 * 2/2005 Yang ..... 206/373
2005/0161356 A1 * 7/2005 Chen ..... 206/373

* cited by examiner

*Primary Examiner*—Jila M Mohandesi
*Assistant Examiner*—Jose S Stephens, III
(74) *Attorney, Agent, or Firm*—Alan Kamrath; Kamrath & Associates PA

(57) ABSTRACT

A tool box includes a main body, a tool holder, a tool handle, a plurality of tool tips, and a cover. Thus, when the cover is removed from the main body, the tool handle is released from the cover and is movable outwardly relative to the main body to drive the tool holder to pivot outwardly from the main body to expose the tool handle and the tool tips for use with a user, thereby facilitating the user operating the tool handle and the tool tips.

20 Claims, 5 Drawing Sheets

TOOL BOX FOR STORING A TOOL HANDLE AND MULTIPLE TOOL TIPS

BACKGROUND OF THE INVENTION

1. Field of the Invention

The present invention relates to a tool box and, more particularly, to a tool box for storing a tool, such as a detachable screwdriver.

2. Description of the Related Art

A conventional tool box comprises a main body and a cover pivotally mounted on the main body. The main body has an inside formed with a plurality of recesses to receive a tool handle (such as a screwdriver handle) and multiple tool tips (such as screwdriver tips). Thus, the tool handle co-operates with any one of the tool tips for use with a user. However, the user has to in turn remove the tool handle and the tool tips from the recesses of the main body when in use and to in turn insert the tool handle and the tool tips into the recesses of the main body when not in use, thereby causing inconvenience to the user.

BRIEF SUMMARY OF THE INVENTION

In accordance with the present invention, there is provided a tool box, comprising a main body having a first end formed with a receiving seat and a second end formed with a receiving groove connected to the receiving seat, a tool holder pivotally mounted on the receiving seat of the main body and formed with a first slot and a plurality of second slots, a tool handle having a first end inserted into the first slot of the tool holder and a second end received in the receiving groove of the main body, a plurality of tool tips each co-operating with the tool handle and each having a first end inserted into a respective second slot of the tool holder and a second end received in the receiving seat of the main body, and a cover pivotally mounted on the main body and rested on the second end of the tool handle to limit the tool handle in the main body.

The primary objective of the present invention is to provide a tool box for storing a tool handle and multiple tool tips.

Another objective of the present invention is to provide a tool box, wherein when the cover is removed from the main body, the tool handle is released from the cover and is movable outwardly relative to the main body to drive the tool holder to pivot outwardly from the main body to expose the tool handle and the tool tips for use with a user, thereby facilitating the user operating the tool handle and the tool tips.

A further objective of the present invention is to provide a tool box, wherein when the cover is secured on the main body, the cover is rested on the second end of the tool handle to limit the tool handle and the tool holder in the main body, so that the tool holder, the tool handle and the tool tips are fully hidden in the main body by limit of the cover.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
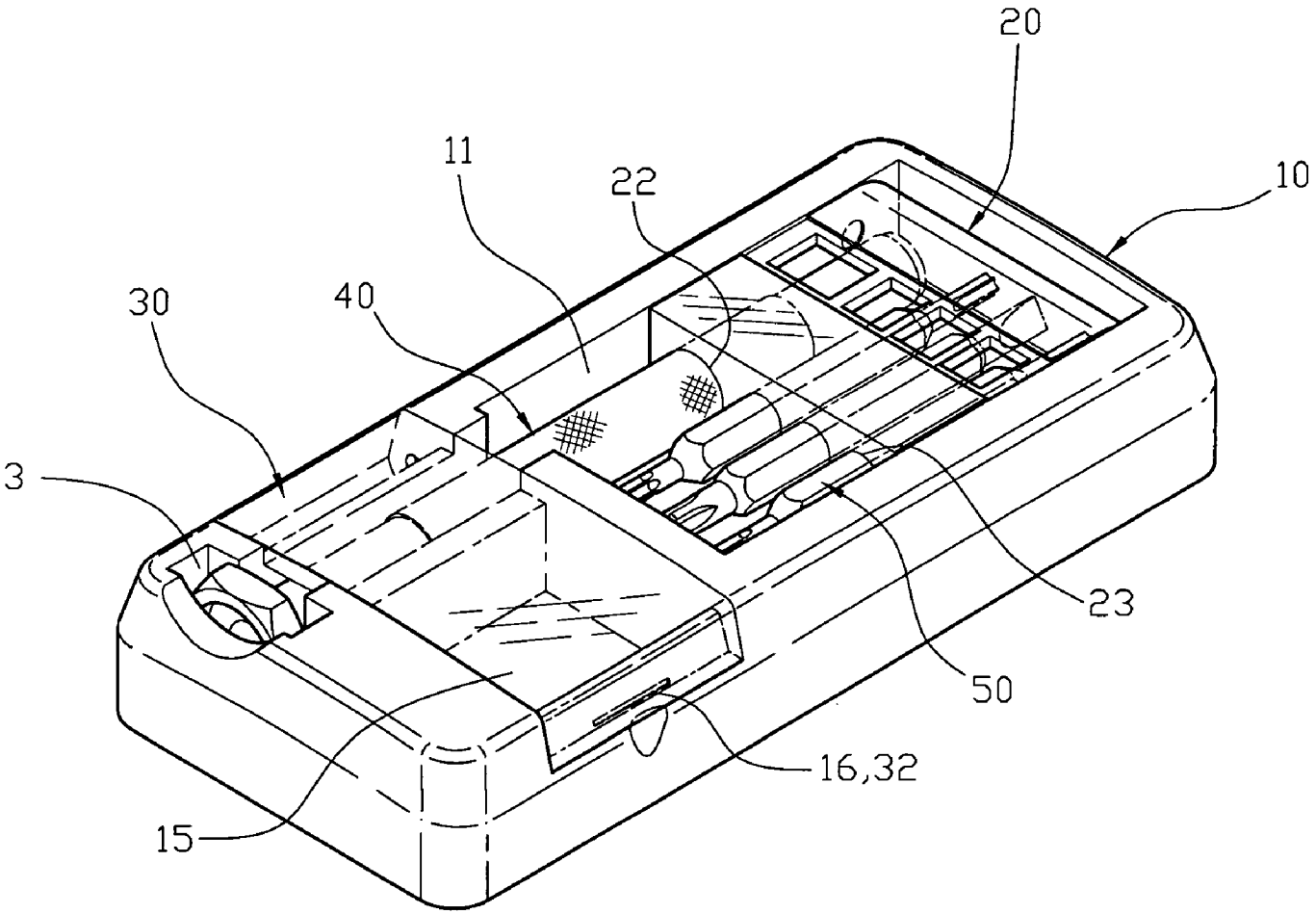
FIG. 1 is a perspective view of a tool box in accordance with the preferred embodiment of the present invention.
Figure 2:
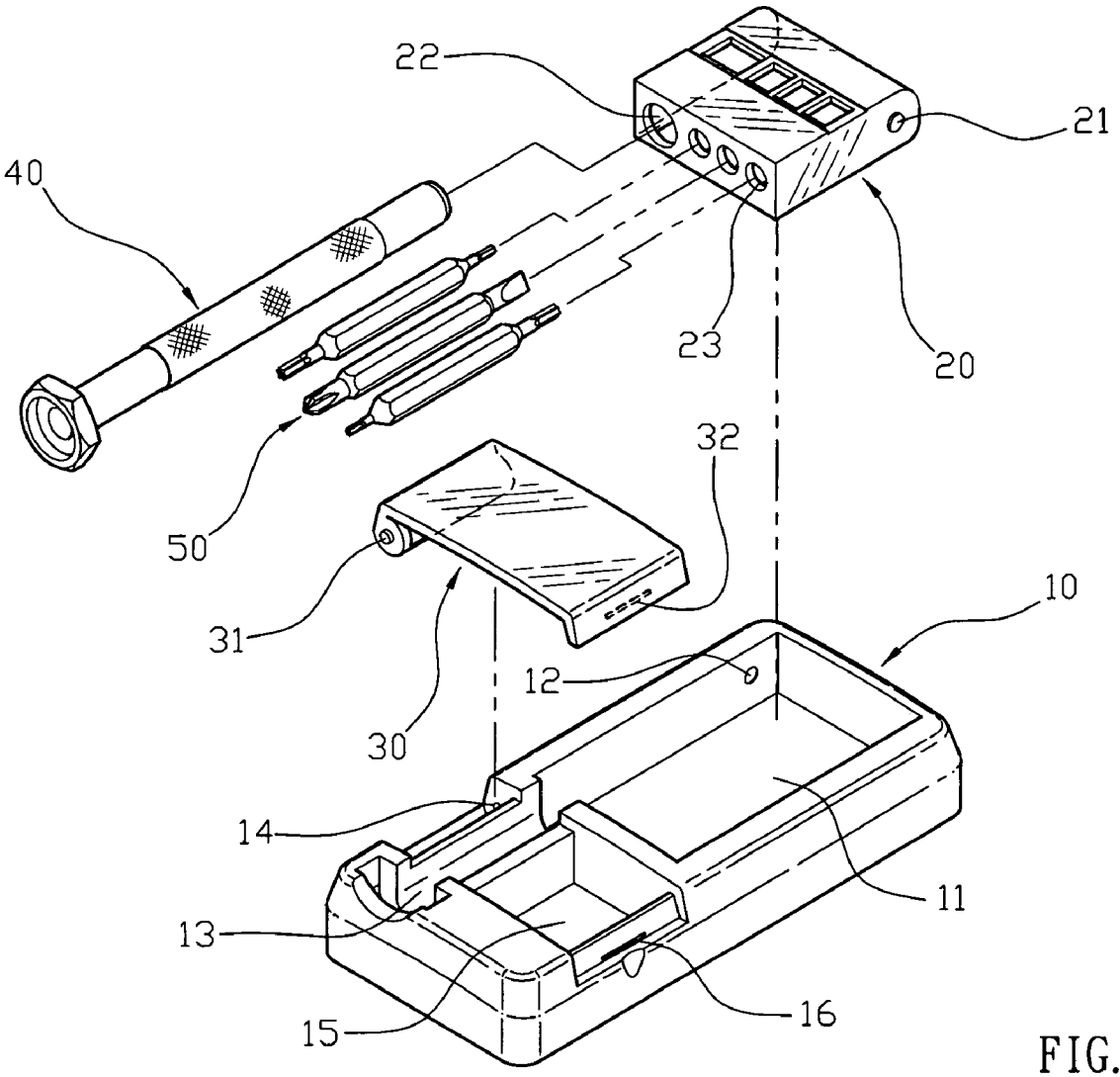
FIG. 2 is an exploded perspective view of the tool box as shown in FIG. 1.

Referring to the drawings and initially to FIGS. 1-4, a tool box in accordance with the preferred embodiment of the present invention comprises a main body 10 having a first end formed with a receiving seat 11 and a second end formed with a receiving groove 13 connected to the receiving seat 11, a tool holder 20 pivotally mounted on the receiving seat 11 of the main body 10 and formed with a first slot 22 and a plurality of second slots 23, a tool handle 40 having a first end inserted into the first slot 22 of the tool holder 20 and a second end received in the receiving groove 13 of the main body 10, a plurality of tool tips 50 each co-operating with the tool handle 40 and each having a first end inserted into a respective second slot 23 of the tool holder 20 and a second end received in the receiving seat 11 of the main body 10, and a cover 30 pivotally mounted on the main body 10 and rested on the second end of the tool handle 40 to limit the tool handle 40 in the main body 10.

The receiving seat 11 of the main body 10 has a hollow inside and has a wall formed with two opposite pivot holes 12. The second end of the main body 10 is formed with a receiving recess 15 located between the receiving seat 11 and the receiving groove 13 and has a first side formed with two opposite pivot bores 14 and a second side formed with a snapping portion 16. The receiving groove 13 and the receiving recess 15 of the main body 10 are located between the pivot bores 14 and the snapping portion 16.

The tool holder 20 is made of a transparent material and has a first end pivotally mounted in the receiving seat 11 and formed with two opposite pivot shafts 21 pivotally mounted in the pivot holes 12 of the receiving seat 11 and a second end formed with the first slot 22 and the second slots 23. The first slot 22 of the tool holder 20 is aligned with the receiving groove 13 of the main body 10.

The cover 30 is made of a transparent material and is pivotable in a direction perpendicular to that of the tool holder 20. The cover 30 has a first end formed with two opposite pivot axles 31 pivotally mounted in the pivot bores 14 of the main body 10 and a second end formed with a snapping section 32 detachably snapped onto the snapping portion 16 of the main body 10.

The first end of the tool handle 40 is partially inserted into the first slot 22 of the tool holder 20 and partially received in the receiving seat 11 of the main body 10 as shown in FIG. 1.

When the cover 30 is secured on the main body 10 as shown in FIG. 1, the cover 30 is rested on the second end of the tool handle 40 to limit the tool handle 40 in the main body 10 and to limit the tool holder 20 in the main body 10. At this time, the tool holder 20, the tool handle 40 and the tool tips 50 are fully hidden in the receiving seat 11 and the receiving groove 13 of the main body 10 by limit of the cover 30.

Figure 3:
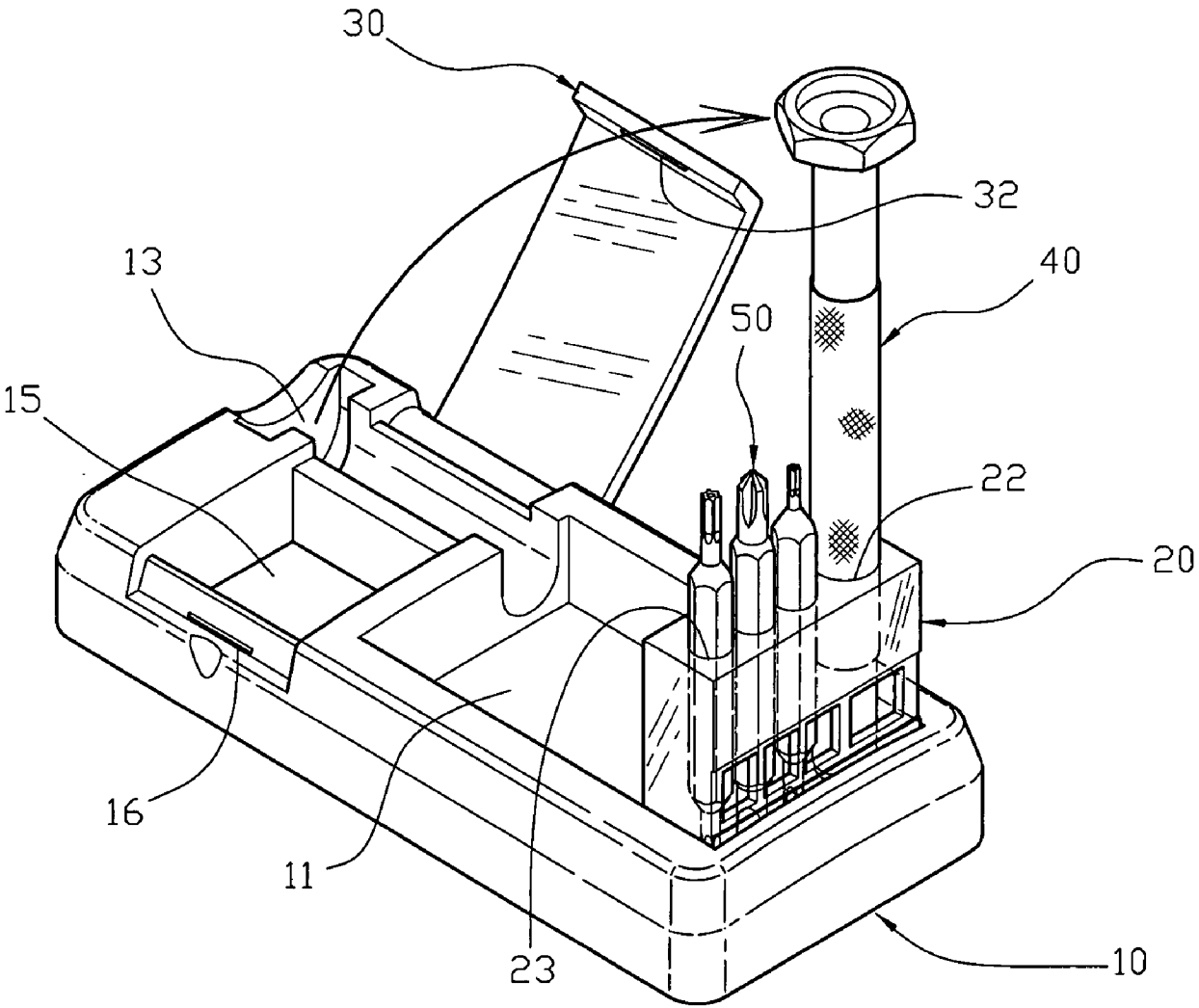
FIG. 3 is a schematic operational view of the tool box as shown in FIG. 1.
Figure 4:
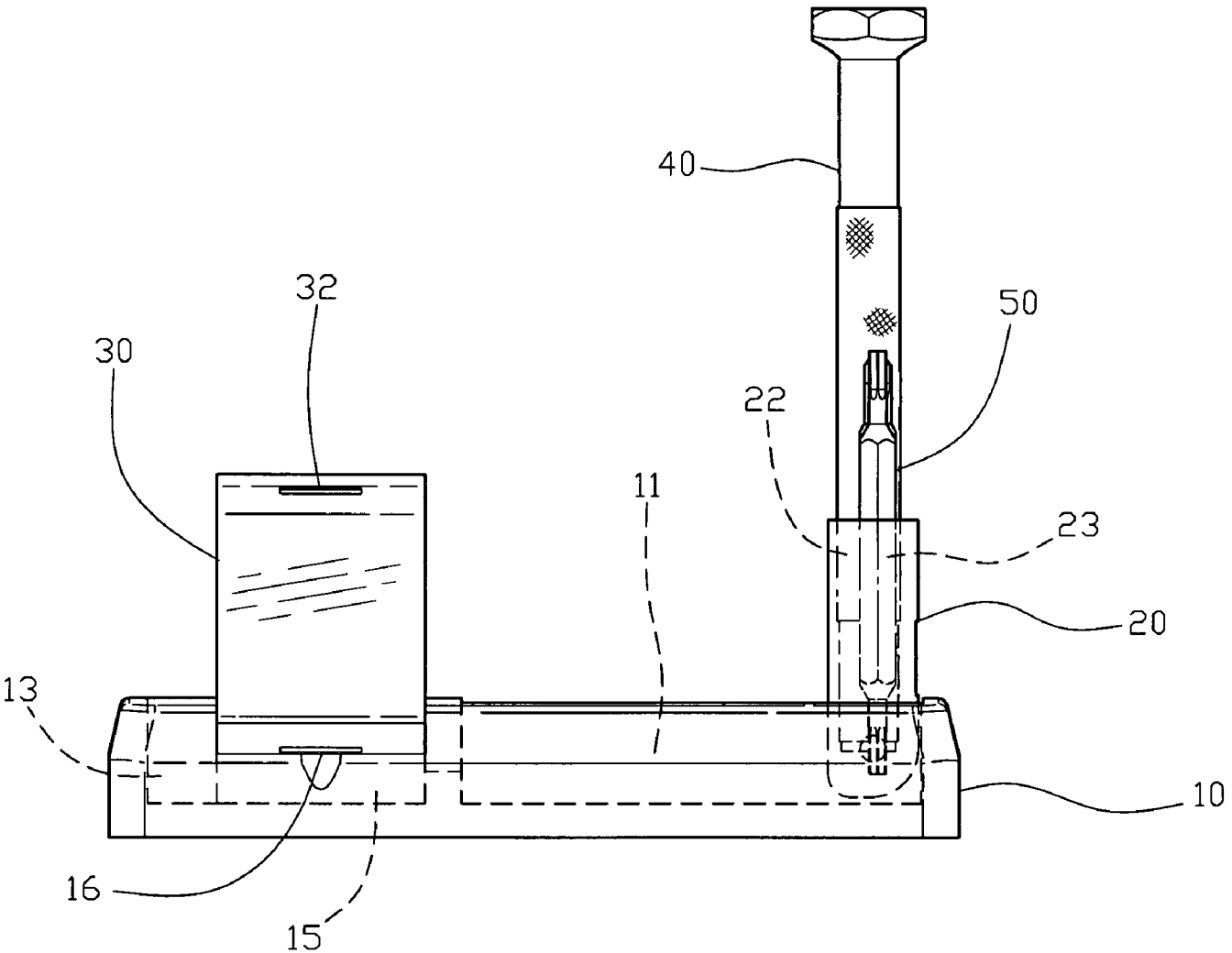
FIG. 4 is a plan view of the tool box as shown in FIG. 3.

When the cover 30 is removed from the main body 10 as shown in FIGS. 3 and 4, the tool handle 40 is released from the cover 30 and is movable outwardly relative to the main body 10 to drive the tool holder 20 to pivot outwardly from the main body 10 to expose the tool handle 40 and the tool tips 50 for use with a user.

Figure 5:
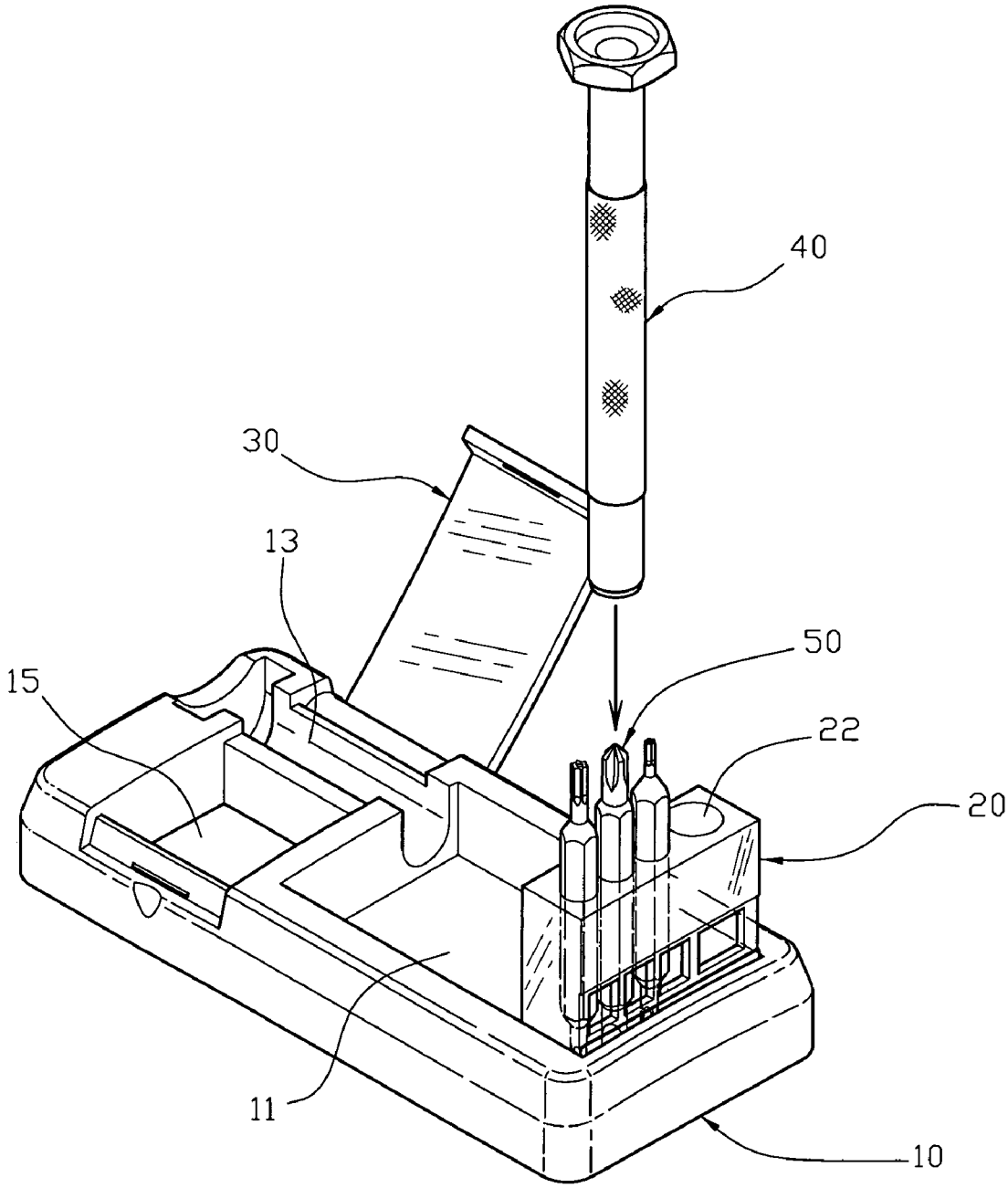
FIG. 5 is a schematic operational view of the tool box as shown in FIG. 3.

As shown in FIG. 5, the tool handle 40 co-operates with any one of the tool tips 50.

Accordingly, when the cover 30 is removed from the main body 10, the tool handle 40 is released from the cover 30 and is movable outwardly relative to the main body 10 to drive the tool holder 20 to pivot outwardly from the main body 10 to expose the tool handle 40 and the tool tips 50 for use with a user, thereby facilitating the user operating the tool handle 40 and the tool tips 50. In addition, when the cover 30 is secured on the main body 10, the cover 30 is rested on the second end of the tool handle 40 to limit the tool handle 40 and the tool holder 20 in the main body 10, so that the tool holder 20, the tool handle 40 and the tool tips 50 are fully hidden in the main body 10 by limit of the cover 30.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A tool box, comprising:

a main body having a first end formed with a receiving seat and a second end formed with a receiving groove connected to the receiving seat;

a tool holder pivotally mounted on the receiving seat of the main body and formed with a first slot connected to the receiving seat and a plurality of second slots each connected to the receiving seat;

a tool handle received in the receiving seat of the main body and having a first end inserted into the first slot of the tool holder and a second end protruded outwardly from the receiving seat of the main body and received in the receiving groove of the main body;

a plurality of tool tips each co-operating with the tool handle and each having a first end inserted into a respective second slot of the tool holder and a second end received in the receiving seat of the main body;

a cover pivotally mounted on the second end of the main body and rested on the second end of the tool handle to limit the tool handle in the main body.

2. The tool box in accordance with claim 1, wherein the tool holder has a chamfered first end pivotally mounted and fully received in the receiving seat and a second end formed with the first slot and the second slots.

3. The tool box in accordance with claim 2, wherein the receiving seat of the main body has a wall formed with two opposite pivot holes, and the first end of the tool holder is formed with two opposite pivot shafts pivotally mounted in the pivot holes of the receiving seat.

4. The tool box in accordance with claim 1, wherein the first slot of the tool holder is aligned with the receiving groove of the main body.

5. The tool box in accordance with claim 1, wherein the cover is pivotable relative to the main body in a first direction;

the tool holder is pivotable relative to the main body in a second direction that is perpendicular to the first direction of the cover.

6. The tool box in accordance with claim 1, wherein the second end of the main body has a first side formed with two opposite pivot bores and a second side formed with a snapping portion, and the cover is perpendicular to the tool handle and has a protruding first end formed with two opposite pivot axles pivotally mounted in the pivot bores of the main body and a protruding second end having an inner wall formed with a snapping section detachably snapped onto the snapping portion of the main body.

7. The tool box in accordance with claim 6, wherein the second end of the main body is formed with a receiving recess located between and isolated from the receiving seat and the receiving groove.

8. The tool box in accordance with claim 7, wherein the receiving groove and the receiving recess of the main body are located between the pivot bores and the snapping portion of the main body and the cover traverses the receiving groove and the receiving recess of the main body.

9. The tool box in accordance with claim 1, wherein the toll handle extends through the receiving seat of the main body into the receiving groove of the main body;

the first end of the tool handle is partially inserted into the first slot of the tool holder and partially received in the receiving seat of the main body.

10. The tool box in accordance with claim 1, wherein when the cover is secured on the main body, the cover is rested on the second end of the tool handle to limit the tool handle in the main body and to limit the tool holder in the main body.

11. The tool box in accordance with claim 10, wherein the cover is partially rested on the tool handle and is spaced from the tool holder and the toll tips;

the tool holder, the tool handle and the tool tips are fully hidden in the receiving seat and the receiving groove of the main body by limit of the cover.

12. The tool box in accordance with claim 1, wherein when the cover is removed from the main body, the tool handle is released from the cover and is movable outwardly relative to the main body to drive the tool holder to pivot outwardly from the main body to expose the tool handle and the tool tips.

13. The tool box in accordance with claim 1, wherein the tool handle co-operates with any one of the tool tips.

14. The tool box in accordance with claim 1, wherein the tool holder is made of a transparent material.

15. The tool box in accordance with claim 1, wherein the cover is made of a transparent material.

16. The tool box in accordance with claim 1, wherein the receiving seat of the main body has a rectangular hollow inside.

17. The tool box in accordance with claim 1, wherein the cover partially covers a surface of the main body when the cover is rested on the second end of the tool handle.

18. The tool box in accordance with claim 1, wherein the tool holder and the tool tips are exposed outwardly from the receiving seat of the main body when the cover is rested on the second end of the tool handle.

19. The tool box in accordance with claim 1, wherein the tool handle is partially exposed outwardly from the receiving seat of the main body when the cover is rested on the second end of the tool handle.

20. The tool box in accordance with claim 1, wherein the tool holder is fully received in and encompassed by the receiving seat of the main body.

* * * * *